United States Patent [19]

Cotter

[11] 4,154,077

[45] May 15, 1979

[54] APPARATUS AND METHOD FOR MANUFACTURING CURVED BUILDING PANELS

[75] Inventor: Donald P. Cotter, San Francisco, Calif.

[73] Assignee: Field Form, Inc., San Francisco, Calif.

[21] Appl. No.: 883,618

[22] Filed: Mar. 6, 1978

[51] Int. Cl.[2] ..... B21D 5/14

[52] U.S. Cl. ..... 72/166; 72/173

[58] Field of Search ..... 72/166, 170, 171, 173–175, 72/177

[56] References Cited

U.S. PATENT DOCUMENTS

| | | | |
|---|---|---|---|
| 2,279,197 | 4/1942 | Hoell | 72/171 |
| 2,339,355 | 1/1944 | Rutten | 72/129 |
| 2,986,193 | 5/1961 | Howell | 72/177 X |
| 3,073,021 | 1/1963 | Goodwill et al. | 72/177 |

*Primary Examiner*—Milton S. Mehr

*Attorney, Agent, or Firm*—Townsend and Townsend

[57] ABSTRACT

Apparatus and method for forming an elongate panel having a two-dimensional sectional profile into a curved configuration is disclosed. A pair or juxtaposed feed rolls compress the panel between them and advance the panel. A curving roll is located proximate and downstream of the feed rolls. The curving roll has a surface conformed to the outside surface of the panel, and is located in the path of the panel as it exits the feed rolls to bend the panel into a curved configuration. An anti-distortion roll is juxtaposed to the curving roll. The anti-distortion roll has a surface conformed to the inside surface of the panel, and the panel is compressed between the curving roll and the anti-distortion roll. The combination of the curving roll, the anti-distortion roll, and feed rolls cause the panel to bend about a neutral line within the panel, and the bending of the panel does not cause distortion of its side walls. To further inhibit unwanted distortion, the curving and anti-distortion rolls may be driven at a slightly greater speed than the feed rolls to tension the panel as it is curved.

8 Claims, 5 Drawing Figures

APPARATUS AND METHOD FOR MANUFACTURING CURVED BUILDING PANELS

BACKGROUND OF THE INVENTION

The present invention relates to apparatus and a method for forming an elongate building panel having a two-dimensional section profile into a curved configuration for use in constructing frameless building structures.

The increased cost of building construction has necessitated the exploration of alternate forms of construction with a view towards minimizing costs. One method of decreasing the costs of construction is to utilize building structures which are less labor intensive to construct. One type of building construction in which labor expenses can be minimized is a frameless building construction comprised of arcuate, generally semicircular panels in which the panels not only provide the weather-proof skin but the structural support for the building as well.

Constructing frameless building structures from arcuate metal panels is well known. However, the size of such buildings is generally quite restricted because of the strength required of the building panels, and particularly their resistance to bending loads on the panels which result from external forces on the structure, such as wind, snow and the like. The weight of the panels themselves, which are typically steel or aluminum, also improve bending loads on the panels.

The panels used to form a frameless, arcuate structure must be bent to their desired arcuate configuration. Bending a completely flat panel causes no difficulties, but a flat panel has little resistance to bending loads, and thus provides insufficient structural strength for all but very small buildings. To enhance the resistance of the panel to bending, it is generally provided with a two-dimensional profile. However, forming such a panel into a curved configuration is quite difficult. Such a panel is generally bent about its outermost surface to form the panel into a curved shape, and the interior portion of the two-dimensional panel section obviously must contract to accommodate the curving of the panel about its outermost surface.

Attempts have been made in the past to curve the building panel by simply passing in between a pair of feed rolls, and bending it by using a curving roll which forces the panel into an arcuate configuration. While acceptable for panels with little depth, this technique has been found to be deficient when panels having substantial depth are used because the side walls of the panel and the internal portion thereof collapse, thus distorting the panel.

To accommodate the collapsing of the internal portion of the panel such internal portions are generally crimped, as illustrated in the patent to Ouellet, U.S. Pat. No. 3,111,788, and the patent to Knudson, U.S. Pat. No. 3,902,288. While such crimping techniques allow the use of a curved panel with a two-dimensional section profile, the crimps themselves significantly weaken the resistance of the interior portion of the panel to tension and compression loads, and thus the resistance of the panel as a whole to bending loads. The weakened resistance of the crimped panel to bending loads substantially defeats the object of using the two-dimensional panel.

As an alternative to the crimping techniques discussed above, the patent to Goodwill et al., U.S. Pat. No. 3,173,225, proposes a panel in which the side walls of the panel are squeezed to extrude the panel into a curved configuration. However, the compressive forces necessary to achieve the intended object of Goodwill are extremely large, and if such large forces were exerted on the panel in the apparatus proposed by Goodwill, it would appear that the panel would simply be squeezed out of the machine. Applicant is unaware of use in the industry of the system proposed by Goodwill.

SUMMARY OF THE INVENTION

The present invention provides apparatus and a method for forming an elongate building panel having a two-dimensional sectional profile into a curved configuration. A pair of juxtaposed feed rolls compress the panel between them and advance the panel. A curving roll is located proximate and downstream of the feed rolls. The curving roll has a surface conformed to the outside surface of the panel, and is located in the path of the panel as it exits the feed rolls to bend the panel into a curved configuration. An anti-distortion roll is juxtaposed to the curving roll. The anti-distortion roll has a surface conformed to the inside surface of the panel, and the panel is compressed between the curving and anti-distortion rolls.

The curving roll, the anti-distortion roll, and the feed rolls of the present invention act in combination to bend the panel about a neutral line within the panel. This is in contrast to prior art techniques in which the outer extremity of the panel remains fixed, and the interior portion of the panel is compressed. In the present invention, the exterior portion of the panel outside of the neutral line within the panel is extended, and the interior of the panel within the neutral line is compressed. As a result, the strain on any portion of the panel is substantially reduced to no more than about half the strain necessary using prior art techniques.

The reduced strain on the panel as it is curved according to the teachings of the present invention, and the manner in which the panel is confined by the curving roll, anti-distortion roll, and the feed rolls, substantially prevent the side walls of the panel from distorting as the panel is curved. Crimps need not be taken in any portion of the panel, and thus no weak points are formed in any portion of the panel to reduce its resistance to bending loads. A panel formed according to the teachings of the present invention is thus far more resistant to bending loads than panels formed according to prior art techniques, greatly facilitating the construction of large, frameless arcuate buildings. In addition, because of the increased strength of the panels, a lighter gauge metal can be used to reduce material costs and the forces required to effect the curving of the panel.

To further inhibit unwanted distortion in the panel as it is curved, the curving and anti-distortion rolls of the present invention may be driven at a slightly greater speed than the feed rolls. This speed differential will result in a tensioning of the panel between the two sets of rolls as it is being curved. This tensioning effects a cold working of the material, and enhances the strength of the curved panel as well as eliminating unwanted distortion.

The novel features which are characteristic of the invention, as to organization and method of operation, together with further objects and advantages thereof will be better understood from the following description considered in connection with the accompanied drawings which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
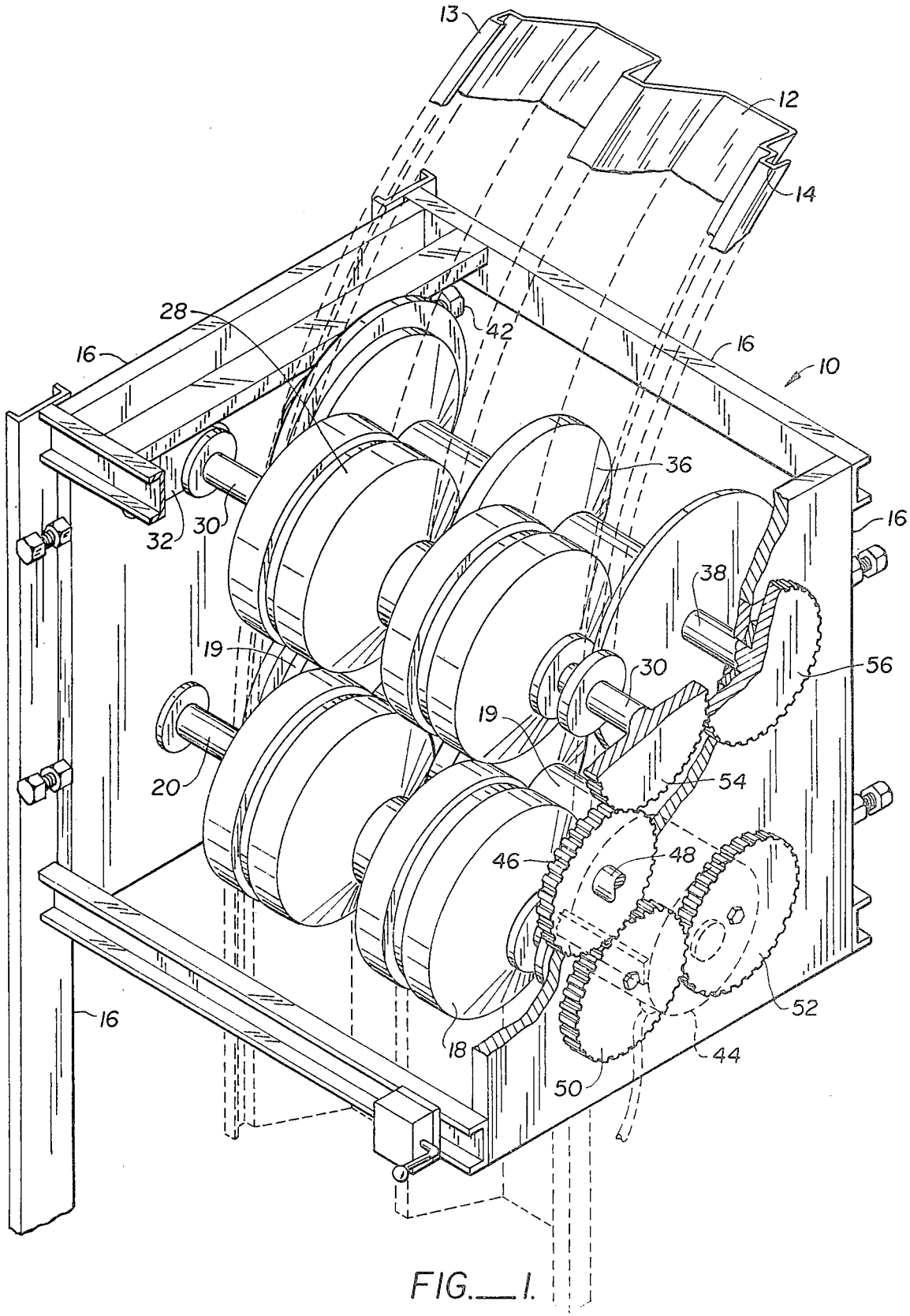
FIG. 1 is a perspective, partially cut away view of the preferred embodiment of the present invention.
Figure 2:
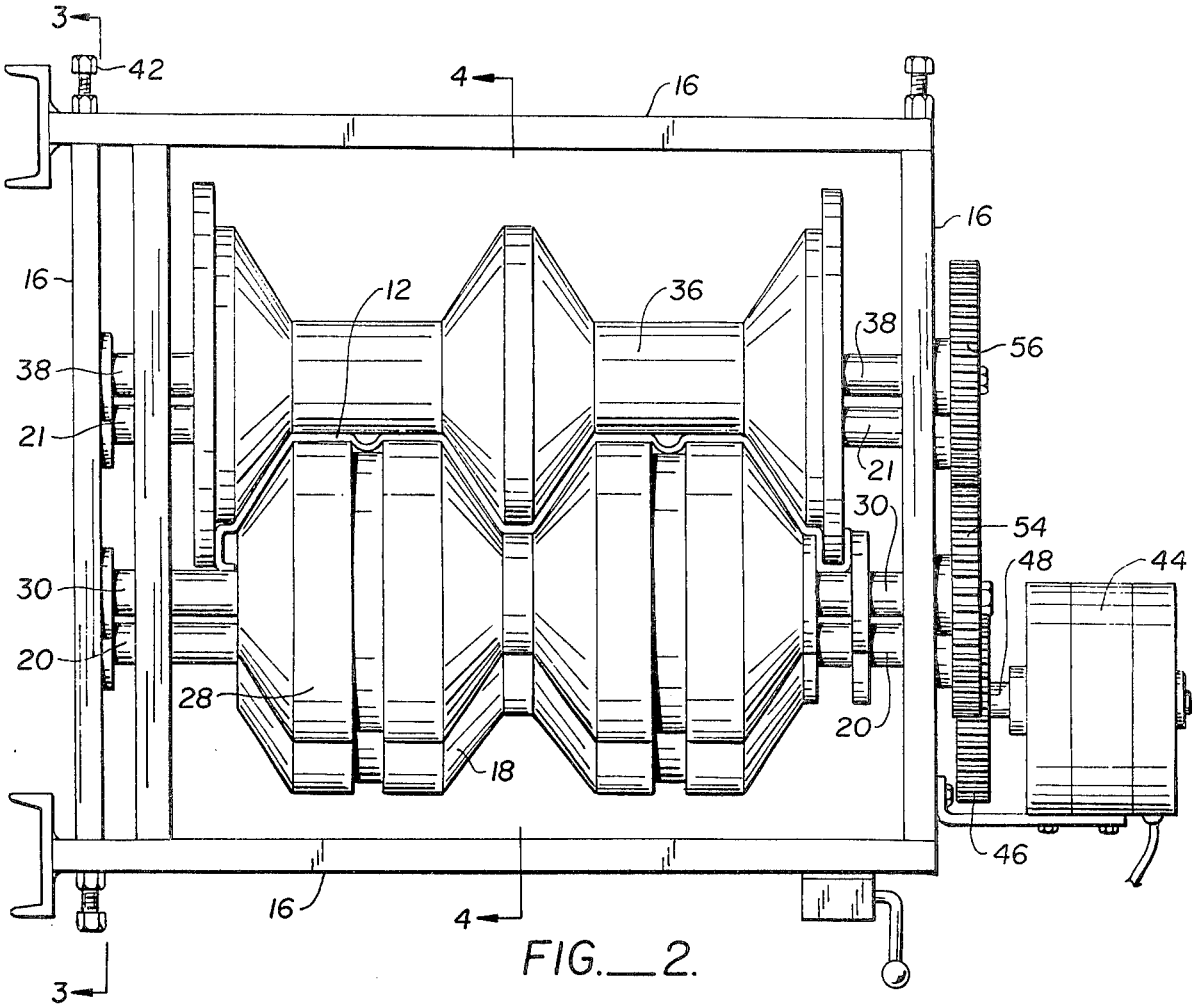
FIG. 2 is a plan view of the preferred embodiment of FIG. 1.
Figure 3:
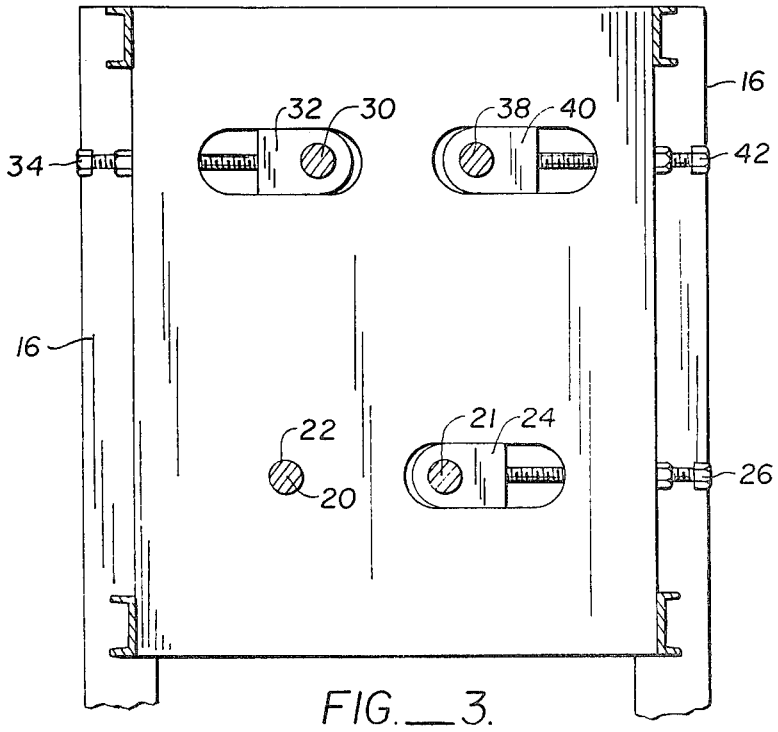
FIG. 3 is a section view taken along lines 3—3 of FIG. 2.
Figure 5:
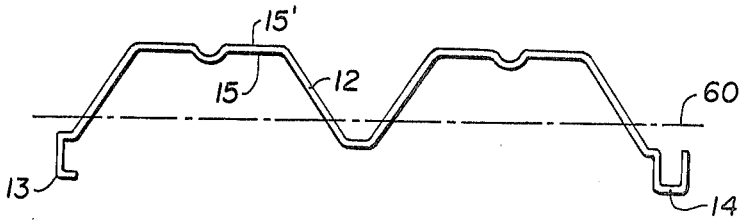
FIG. 5 is a section view of a preferred embodiment of the two-dimensional panel used in the present invention.

The elements of the preferred embodiment 10 of the present invention used to curve a building panel 12 into an arcuate configuration are illustrated generally by way of reference to FIGS. 1–5. As illustrated in FIG. 5, building panel 12 has a two-dimensional section profile, with flanges 13, 14 for attachment to adjacent similar panels. Surface 15 is adapted to form the outer surface of the building structure formed with panel 12, and surface 15' provides the inside surface. Because of the two-dimensional profile of panel 12, it has substantial resistance to bending loads, even though it is constructed from relatively thin metal stock.

Embodiment 10 includes a box frame 16 on which the various elements of the system are mounted. A pair of feed rolls 18, 19 are mounted on shafts 20, 21. Shaft 20 projects through apertures such as 22 on the opposite sides of box frame 16 so that the feed roll 18 is rotatable about a fixed axis. Shaft 21 is rotatably mounted to sliding shoes such as 24 in frame 16 which can be displaced by bolts such as 26 to adjust to the thickness of panel 12. Panel 12 passes between feed rolls 18, 19 and bolts 26 are used to bias feed roll 19 toward feed roll 18 so that the panel is compressed therebetween. The outer surfaces of feed rolls 18, 19 are conformed to the exterior and interior surfaces respectively of panel 12 so that the panel is secured between the feed rolls.

A curving roll 28 is mounted on shaft 30. Shaft 30 is in turn rotatably attached to a sliding block such as 32 whose position can be adjusted using adjustment bolts such as 34. Curving roll 28 is located in the path of panel 12 as it exits feed rolls 18, 19, and has a forming surface which is conformed to the outside surface of panel 12. As a result, curving roll 28 causes panel 12 to bend as it exits the feed rolls into an arcuate configuration.

An anti-distortion roll 36 is juxtaposed to curving roll 28, and is mounted on shaft 38. Shaft 38 is rotatably attached to sliding blocks such as 40 in frame 14 whose position can be adjusted by bolts such as 42. Bolts 34 and 42 are operated in combination to achieve the desired amount of bending of panel 12 and to compress the panel between curving roll 28 and anti-distortion roll 36.

Figure 4:
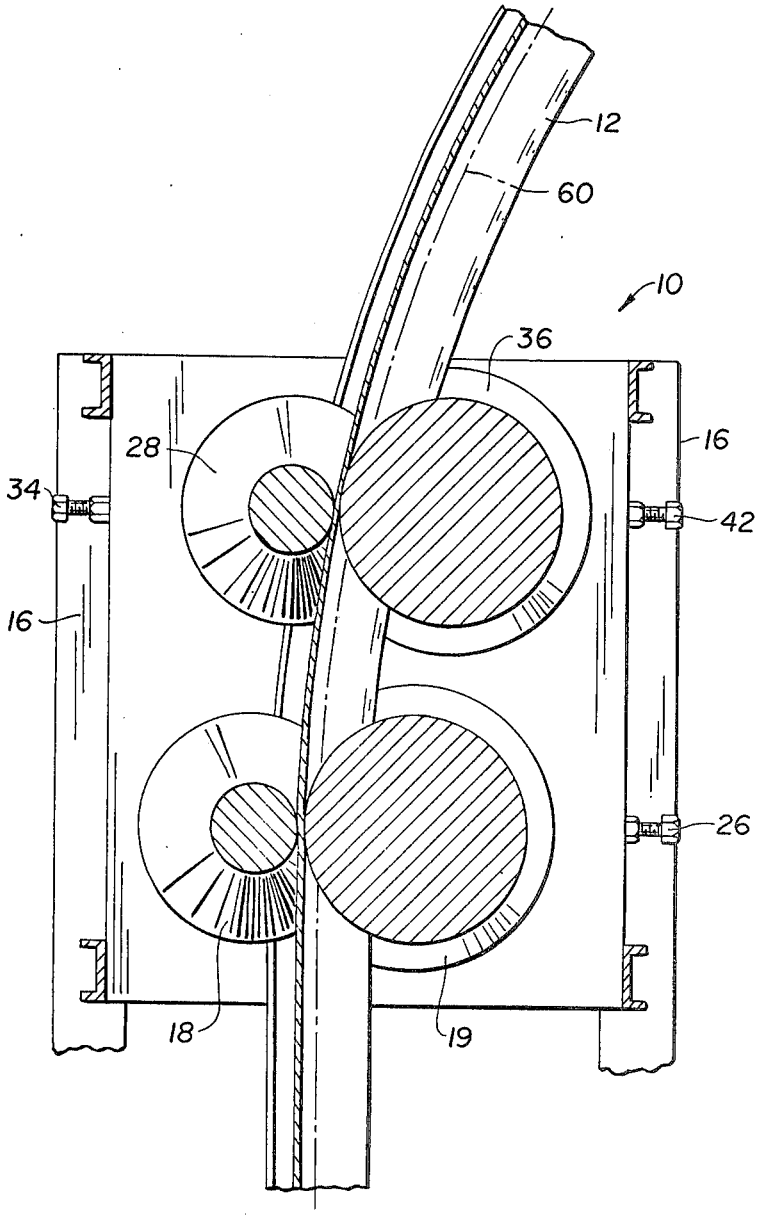
FIG. 4 is a section view taken along lines 4—4 of FIG. 2.

Feed rolls 18, 19, curving roll 28 and anti-distortion roll 36 provide firm support for panel 12 as the panel is being formed into its curved configuration (See FIG. 4). As discussed previously, prior art systems have attempted to form panels into a curved configuration by simply using two feed rolls and a curving roll with only limited success, particularly when the panel section has substantial depth, because the side wall portions of the panel become distorted. However, with the four roll system of the present invention, such distortion has been found to be substantially prevented.

In the preferred embodiment 10 of the present invention, a single electric motor 44 is used to drive each of the rolls. Motor 44 has an output gear 46 located on its drive shaft 48. Output gear 46 engages spur gear 50, which is fixed to shaft 20 so that motor 44 can be used to drive feed roll 18. A second spur gear 52 engages gear 50, and is mounted to shaft 21 so that feed roll 19 is also driven by motor 44.

In the preferred embodiment of the present invention, output gear 46 of motor 44 also engages a spur gear 54 fixed to shaft 30 to drive curving rolls 28. Spur gear 54 engages another spur gear 56 attached to shaft 38 to drive anti-distortion roll 36.

In the preferred embodiment of the present invention, the diameter of gears 54, 56 is slightly less than the diameter of gears 50, 52 so that curving roll 28 and outside distortion roll 36 are driven at a slightly higher rotational speed than feed rolls 18, 19. As a result, panel 12 is tensioned between the two sets of rolls. This tensioning has been found to further inhibit distortion of the side walls of panel 12, particularly for deep panels. In addition, this tensioning effect has been found to achieve a cold working of panel 12 as it is curved, thus increasing the strength of the panel and its resistance to bending loads.

As panel 12 passes through the embodiment 10 of the present invention, as illustrated in FIG. 4, the confinement of the panel between feed rolls 18, 19, curving roll 28 and anti-distortion roll 36 cause the panel to curve about axis 60 within the panel. This is in contrast with prior art techniques in which the panel is bent about the outermost portion of the panel, resulting in extensive compression of the interior portion. The present invention, by bending panel 12 about an interior axis, minimizes the strain of any one portion of the panel as it is being curved, thereby minimizing the tendency of the panel to distort during the curving process.

While a preferred embodiment of the present invention has been illustrated in detail, it is apparent that modifications of that embodiment will occur to those skilled in the art. For example, at least for panels with little sectional depth, it may not be necessary to drive the curving and anti-distortion rolls to tension the panel. However, it is to be expressly understood that such modifications and adaptations are within the spirit and scope of the present invention, as set forth in the following claims.

What is claimed is:

1. Apparatus for forming an elongate building panel having inside and outside surfaces respectively and a two-dimensional sectional profile into a curved configuration, said apparatus comprising:

a pair of juxtaposed feed rolls having surfaces generally conformed to the respective inside and outside surfaces of the panel and adapted to compress the panel therebetween;

means for rotating at least one of the feed rolls to feed the panel between said feed rolls;

a curving roll located proximate and downstream of the feed rolls, said curving rolls having a surface conformed to the outside surface of the panel and located in the path of the panel as the panel member exits the feed rolls to bend the panel into a curved configuration; and an anti-distortion roll juxtaposed to the curving roll and adapted to compress the panel therebetween so that the panel bends about a neutral line within the panel and the bending of the panel does not cause unwanted distortion of the panel.

2. Apparatus as recited in claim 1 wherein said rotating means comprises means for driving at least one of the feed rolls.

3. Apparatus as recited in claim 2 and additionally comprising means for driving the curving roll and the anti-distortion roll at a slightly greater speed than the feed roll is driven to tension the panel between the feed rolls and the curving and anti-distortion rolls and further insure that the bending of the panel does not cause unwanted distortion thereof.

4. Apparatus as recited in claim 1 and additionally comprising means for driving the curving roll and anti-distortion roll to further insure that the bending of the panel does not cause unwanted distortion thereof.

5. A method for forming an elongate building panel having inside and outside surfaces respectively and a two-dimensional sectional profile into a curved configuration, said method comprising the steps of:

feeding the panel member between a pair of juxtaposed feed rollers having surfaces generally conformed to the respective inside and outside surfaces of the panel;

compressing the panel between said feed rollers;

bending the panel by interposing a curving roll downstream of the feed rolls; and securing the panel to the curving roll by compressing the panel between the curving roll and an anti-distortion roll so that the panel bends about a neutral line within the panel and the bending of the panel does not cause unwanted distortion of the panel.

6. A method as recited in claim 5 and additionally comprising the steps of driving the feed rolls at a first rotational velocity, and driving the curving and anti-distortion rolls at a second rotational velocity slightly greater than that of the feed rolls to tension the panel between the feed rolls and the curving and anti-distortion rolls to further insure that the bending of the panel does not cause unwanted distortion thereof.

7. An apparatus for forming an elongate building panel having inside and outside surfaces respectively and a two-dimensional sectional profile into a curved configuration, said apparatus comprising:

a pair of juxtaposed feed rolls having surfaces generally conformed to the respective inside and outside surfaces of the panel and adapted to compress the panel therebetween;

a curving roll located proximate and downstream of the feed rolls, said curving roll having a surface conformed to the outside surface of the panel and located in the path of the panel as the panel member exits the feed rolls to bend the panel into a curved configuration;

an anti-distortion roll juxtaposed to the curving roll and adapted to compress the panel therebetween; and means for driving the feed rolls, the curving roll, and the anti-distortion roll, said driving means including means for driving the curving and anti-distortion rolls at a slightly greater rotational speed than the feed rolls to tension the panel between the feed rolls and the curving and anti-distortion rolls to inhibit unwanted distortion of the panel.

8. A method for forming an elongate building panel having inside and outside surfaces respectively and a two-dimensional sectional profile into a curved configuration, said method comprising the steps of:

feeding the panel member between a pair of juxtaposed feed rolls having surfaces generall conformed to the respective inside and outside surfaces of the panel;

driving the feed rolls at a first rotational velocity;

compressing the panel between said feed rolls;

bending the panel by interposing a curving roll downstream of the feed rolls;

securing the panel to the curving roll by compressing the panel between the curving roll and an anti-distortion roll; and driving the curving and anti-distortion rolls at a second rotational velocity slightly greater than that of the feed rolls to tension the panel between the feed rolls and the curving and anti-distortion rolls so that the panel bends about a neutral line within the panel and the bending of the panel does not cause unwanted distortion of the panel.

* * * * *